United States Patent [19]

Courtney

[11] Patent Number: 4,778,481

[45] **Date of Patent: * Oct. 18, 1988**

[54] DIESEL FUEL AND METHOD FOR DEPOSIT CONTROL IN COMPRESSION IGNITION ENGINES

[75] Inventor: Richard L. Courtney, San Rafael, Calif.

[73] Assignee: Chevron Research Company, San Francisco, Calif.

[ * ] Notice: The portion of the term of this patent subsequent to Feb. 4, 2003 has been disclaimed.

[21] Appl. No.: 19,100

[22] Filed: Feb. 26, 1987

Related U.S. Application Data

[63] Continuation of Ser. No. 825,019, Jan. 31, 1986, abandoned, which is a continuation-in-part of Ser. No. 635,383, Jul. 30, 1984, Pat. No. 4,568,358, which is a continuation-in-part of Ser. No. 521,281, Aug. 8, 1983, abandoned, and Ser. No. 537,894, Sep. 30, 1983, abandoned.

[51] Int. Cl.[4] ..... C10L 1/22

[52] U.S. Cl. ..... 44/57; 44/58; 44/63; 44/71

[58] Field of Search ..... 44/57, 58, 63, 71

[56] References Cited

U.S. PATENT DOCUMENTS

| | | | |
|---|---|---|---|
| 4,160,648 | 7/1979 | Lewis et al. | 44/71 |
| 4,191,537 | 3/1980 | Lewis et al. | 44/71 |
| 4,197,409 | 4/1980 | Lilburn | 44/71 |
| 4,198,306 | 4/1980 | Lewis | 252/51.5 |
| 4,236,020 | 11/1980 | Lewis et al. | 44/71 |
| 4,243,798 | 1/1981 | Franklin et al. | 528/371 |
| 4,270,930 | 6/1981 | Campbell et al. | 44/71 |
| 4,274,837 | 6/1981 | Lilburn | 44/71 |
| 4,288,612 | 9/1981 | Lewis et al. | 44/71 |
| 4,329,240 | 5/1982 | Lilburn | 44/72 |
| 4,568,358 | 2/1986 | Courtney | 44/57 |

FOREIGN PATENT DOCUMENTS

| | | |
|---|---|---|
| 0024134 | 2/1981 | European Pat. Off. . |
| 0100665 | 2/1984 | European Pat. Off. . |
| 59-232176 | 12/1984 | Japan . |
| 2026507 | 2/1980 | United Kingdom . |

*Primary Examiner*—William R. Dixon, Jr.
*Assistant Examiner*—Jerry D. Johnson
*Attorney, Agent, or Firm*—S. R. La Paglia; R. C. Gaffney; J. J. DeYoung

[57] ABSTRACT

A diesel fuel composition and method for improving the operation and efficiency of a compression ignition or diesel engine is disclosed comprising operating the engine using a fuel comprising a major amount of hydrocarbon fuel boiling in the diesel range and from about 600 to about 10,000 ppm of an additive comprising a polyoxyalkylene amine or polyamine of from about 500 to about 2,500 molecular weight.

8 Claims, No Drawings

DIESEL FUEL AND METHOD FOR DEPOSIT CONTROL IN COMPRESSION IGNITION ENGINES

CROSS-REFERENCE TO RELATED APPLICATIONS

This is a continuation of application Ser. No. 825,019, filed Jan. 31, 1986, abandoned, which is a continuation-in-part of Ser. No. 635,383 U.S. Pat. No. 4,568,358 filed July 30, 1984, the entire disclosure of which is incorporated herein by reference, which in turn is a continuation-in-part of Ser. No. 521,281, filed Aug. 8, 1983, and Ser. No. 537,894 , abandoned filed Sept. 30, 1983 abandoned, the entire disclosures of which filed Sept. 30, 1983, the entire disclosures of which are incorporated herein by reference.

BACKGROUND OF THE INVENTION

This invention concerns a diesel fuel and method for the cleaning out of deposits which adversely affect the performance of diesel engines. More particularly, this invention concerns the use of hydrocarbyl polyether polyamines as deposit control additives in diesel fuel in a concentration specifically designed to restore engine efficiency.

Until recently, in the United States, diesel engines were primarily limited to heavy uses such as trucks, farm equipment, and railroad engines. With the advent of the widespread acceptance of the passenger automobile utilizing a light-weight diesel engine, diesel fuels were required which did not give rise to severe noise and smoke problems such as those acceptable or tolerated in heavier engines.

Diesel fuels are susceptible to impurities which may arise from a variety of sources. They may occur in the fuel as produced or refined, or may through oxidation resulting from aging, produce soluble and insoluble materials of higher molecular weight and boiling point than the original fuel, which manifest themselves in the engine as colors or gums. Impurities may also be introduced in handling or from corrosion of storage vessels, either in the vehicle or in inventory. There may even be other additives specifically introduced by the manufacturer to solve or prevent some particular problem or improve the fuel itself, for example anti-oxidants, rust preventatives, and the like.

All of these impurities, however, may give rise to deposit formation in the fuel system of compression ignition engines, in particular, at the critical junctions of the fuel injectors. These deposits coat or adhere to injector parts and cause injector sticking, injector tip fuel metering passage fouling, nozzle hole plugging, leakage past critical surfaces, and delayed injection (and, hence, delayed start of combustion). These problems, in turn, result in significantly increased engine noise, smoke emissions, misfiring, low temperature or cold start problems, and idle roughness; and decreased power output and fuel economy.

It is believed that these engine problems are the result of long ignition delays, significantly contributed to by deposits, causing an excessively rapid pressure rise in the cylinder once combustion does occur. Recent evidence suggests that the long delay provides the time for certain chemical reactions to take place in the atomized fuel charge prior to ignition, resulting in products which burn exceedingly rapidly once combustion begins, thereby causing the undesirable rapid pressure rise, and the resultant problems. See "Gasoline and Other Motor Fuels—Diesel Fuel", *Encyclopedia of Chemical Technology,* Kirk-Orthmer, 3rd ed., Vol. 11, pp. 682–689.

SUMMARY OF THE INVENTION

A diesel fuel and method is provided for increasing the cleanliness and efficiency of compression ignition engines and their injector systems. The method consists essentially of operating the engines using a fuel specifically designed for diesel or compression ignition engines and containing an effective amount of additive consisting of various polyether amines or polyamines soluble in hydrocarbon fuel boiling in the diesel fuel range. The boiling point of diesel fuel is ordinarily from 350° F. (177° C.) to 700° F. (371° C.). Alternatively, the method provides for introducing a concentrate containing the preferred additive into the fuel system of a compression ignition engine automobile to promote and maintain said cleanliness and efficiency. In either instance, using either an additized fuel or introducing a concentrate into the fuel, the method requires that the concentration of the additive must be sufficient to achieve in the desired effect. Generally, this concentration is from about 600 to about 10,000 ppm, and preferably from 1,500 to about 5,000 ppm.

The additives used to practice the method of the present invention are comprised of basically three moieties or components: a hydrophobic moiety at one end of the molecule comprising polyoxyalkylene polymer submoieties; a hydrophilic amine moiety at the other end; and a third moiety, a connecting group serving to unite the hydrophilic and hydrophobic ends of the molecule.

The polyoxyalkylene moiety comprises at least one oxyalkylene unit of from 2 to 4 carbon atoms and may be terminated or "capped" with a hydrocarbyl group. The hydrocarbyl terminating group of the polyoxyalkylene moiety may contain from between 1 to 30 carbon atoms. Preferably, the polyoxyalkylene chain is bonded through a terminal oxygen to the appropriate connecting group which is in turn bonded to an amino nitrogen atom in the amine or polyamine group. The polyamine preferably contains from about 2 to about 12 amine nitrogens and from about 2 to about 40 carbon atoms, with a carbon-nitrogen ratio of between 1:1 and 10:1. The compounds have a molecular weight in the range of about 500 to about 2,500, and preferably from about 800 to about 1,500.

DETAILED DESCRIPTION OF THE INVENTION

The present invention comprises a diesel fuel composition and a method for improving the cleanliness and efficiency of a compression ignition or diesel engine by operating the engine using a fuel specifically designed for compression ignition engine use and consisting essentially of a major amount of a liquid hydrocarbon boiling in the diesel range and a minor amount of a fuel additive comprising a polyoxyalkylene (also called polyether) amine or polyamine. The polyether amine or polyamine has a molecular weight of from about 500 to about 2,500, and preferably from about 800 to about 1,500. It is effective when used in a concentration of from about 600 to about 10,000 ppm, more preferably from about 1,500 to about 5,000 ppm.

The additive consists of three parts or moieties. The first is the polyether or polyoxyalkylene moiety, which may or may not be hydrocarbyl terminated or "capped". The polyether moiety is bound through the second moiety, a connecting group or linkage to the nitrogen atom of the third moiety, the amine or polyamine.

As fuel additives, the polyoxyalkylene moiety and the amine moiety are selected to provide solubility in the fuel, and clean-up properties within a diesel engine and its fuel system.

Polyoxyalkylene Moiety

The polyoxyalkylene moiety is ordinarily comprised of polyoxyalkylene polymers containing at least one oxyalkylene unit, preferably 1 to 30 units, and more preferably 5 to 30 units, and most preferably 10 to about 25 oxyalkylene units. When polymerized in the polymerization reaction, a single type of alkylene oxide may be employed. Copolymers, however, are equally satisfactory and random copolymers are readily prepared. Blocked copolymers of oxyalkylene units also provide satisfactory polyoxyalkylene polymers for the practice of the present invention.

The polyoxyalkylene moiety may also be terminated or "capped" by a hydrocarbyl terminating group. This terminating group may be comprised of an alkyl group of from 1 to about 30 carbon atoms, an aryl group of from 6 to about 30 carbon atoms, an alkaryl group of from 7 to about 30 carbon atoms, an aralkyl group of from 7 to about 30 carbon atoms, or a methylol-substituted alkyl group of from 5 to about 30 carbon atoms.

The polyoxyalkylene moiety may ordinarily be prepared in a variety of ways, the most common for the practice of the present invention being by the reaction of an appropriate lower alkylene oxide containing from 2 to 4 carbon atoms with an appropriate initiator; for example, chlorohydrin or an alkyl phenol. In the preferred embodiment, dodecylphenol is used. Copolymers may be readily prepared by contacting the initiator compound with a mixture of alkylene oxides, while the blocked copolymers may be prepared by reacting the initiator first with one alkylene oxide and then another in any order or repetitively under polymerization conditions.

As an example, the polyoxyalkylene moiety derived from an alkyl-phenol-initiated polymerization detailed above is prepared as an alcohol containing a terminal hydroxyl group. The polyether moiety is then attached through the appropriate connecting group to the polyamine moiety by a variety of ways, preferably by reacting the hydroxyl group of the polyoxyalkylene unit with phosgene to form a polyoxyalkylene chloroformate and then reacting the polyoxyalkylene chloroformate with an amine. Alternatively, the hydroxyl group may be reacted with epichlorohydrin to give a methylol-substituted ethyl chloride end group. The resulting polyoxyalkylene alkyl chloride is then reacted with an amine or polyamine to produce the composition of the present invention.

The Connecting Group

The connecting group joining the polyoxyalkylene moiety with the amine moiety may be any relatively small diradical containing at least one carbon, oxygen, sulfur and/or nitrogen atom, and usually containing up to 12 carbon atoms. The connecting group which results and is used in the present composition is ordinarily a function of the method by which the compositions are formed and/or by which the components of the polyoxyalkylene moiety and the polyamine moiety are joined together. Appropriate connecting groups include:

carbamates $-O-\overset{\overset{\displaystyle O}{\|}}{C}-NH-$;

ethylene $-\overset{\overset{\displaystyle Y}{|}}{C}H-\overset{\overset{\displaystyle Y'}{|}}{C}H-$;

oxyethylene $\left(CH_2-CH_2O\right)$;

methylol ethylene $-\overset{\overset{\displaystyle CH_2OH}{|}}{C}H-CH_2-$;

succinates $-O-\overset{\overset{\displaystyle O}{\|}}{C}-CH_2-CH_2-\overset{\overset{\displaystyle O}{\|}}{C}-O-$;

ethers $-O-$;

thioethers $-S-$;

carbonyls $-\overset{\overset{\displaystyle O}{\|}}{C}-$;

carbonates $-O-\overset{\overset{\displaystyle O}{\|}}{C}-O-$;

esters $-\overset{\overset{\displaystyle O}{\|}}{C}-O-$;

amides $-\overset{\overset{\displaystyle O}{\|}}{C}-NY-$; and methylene $-CHY-$;

where Y and Y' independently = H, or an alkyl group of from 1 to 2 carbon atoms.

The most preferred connecting groups are selected from the group consisting of:

ethylene $-\overset{\overset{\displaystyle Y}{|}}{C}H-\overset{\overset{\displaystyle Y'}{|}}{C}H-$;

methylol ethylene $-\overset{\overset{\displaystyle CH_2OH}{|}}{C}H-CH_2-$;

carbonyls $-\overset{\overset{\displaystyle O}{\|}}{C}-$; and methylene $-CHY-$;

where the substituents are as previously defined.

The Amine Moiety

The amine moiety of the polyether amine is derived from ammonia or, more preferably, from a polyamine having from about 2 to about 12 amine nitrogen atoms and from about 2 to about 40 carbon atoms. The polyamine preferably has a carbon to nitrogen ratio of from about 1:1 to about 10:1. The polyamine will contain at least 1 primary or secondary amine nitrogen atom. The polyamine may be substituted with a substituent group selected from (A) hydrogen; (B) hydrocarbyl groups from about 1 to about 10 carbon atoms; (C) acyl groups from about 2 to about 10 carbon atoms; and (D) monoketo, monohydroxy, monocyano, lower alkyl and lower alkoxy derivatives of (B), (C). "Lower", as used in lower alkyl and lower alkoxy, means a group containing about 1 to 6 carbon atoms. "Hydrocarbyl" denotes an organic radical composed of carbon and hydrogen which may be aliphatic, alicyclic, aromatic or combinations thereof, e.g. aralkyl. The substituted polyamines of the present invention are generally, but not necessarily, N-substituted polyamines. The acyl groups falling within the definition of the aforementioned (C) substituents are such as propionyl, acetyl, etc. The more preferred substituents are hydrogen, $C_1$ to $C_6$ alkyls, and $C_1$–$C_6$ hydroxyalkyls.

The more preferred polyamines finding use within the scope of the method of the present invention are polyalkylene polyamines, including alkylene diamine and substituted polyamines, e.g. alkyl and hydroxyalkyl-substituted polyalkylene polyamines. Preferably the alkylene groups contain from 2 to 6 carbon atoms, there being preferably from 2 to 3 carbon atoms between the nitrogen atoms. Such groups are exemplified by ethyleneamines and include ethylene diamine, diethylene triamine, di(trimethylene) triamine, dipropylenetriamine, triethylenetetramine, etc. Such amines encompass isomers which are the branched-chain polyamines and the previously mentioned substituted polyamines, including hydroxy and hydrocarbyl-substituted polyamines. Among the polyalkylene polyamines, those containing 2 to 12 amine nitrogen atoms and 2 to 24 carbon atoms, are especially preferred and the $C_2$ to $C_3$ alkylene polyamines are most preferred, in particular, the lower polyalkylene polyamines, e.g. ethylene diamine, tetraethylenepentamine, etc.

In many instances a single compound will not be used as reactant in the preparation of the compositions used to practice this invention, in particular the polyamine component. That is, mixtures will be used in which one or two compounds will predominate with the average composition indicated.

A generalized, preferred formula for the polyether polyamines finding utility in this invention is as follows:

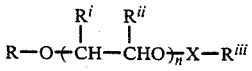

wherein

R=an alkyl group of 1 to 30 carbon atoms, aryl group of 6 to 30 carbon atoms, alkaryl group of 7 to 30 carbon atoms, aralkyl group of 7 to 30 carbon atoms, or methylol-substituted alkyl group of 5 to 30 carbon atoms;

$R^i$ and $R^{ii}$ independently=hydrogen, methyl or ethyl;

n=1 to 30, preferably 10 to 25;

X=connecting group selected from the group consisting of:

carbamates 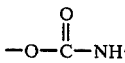

ethylene 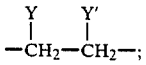

oxyethylene 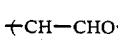

methylol ethylene 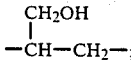

-continued succinates 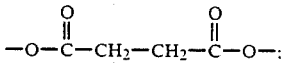

ethers —O—;

thioethers —S—;

carbonyls 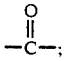

carbonates 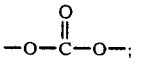

esters 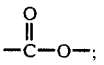

amides 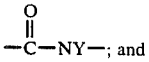 and methylene —CHY—;

where

Y and Y′ independently=H, or an alkyl group of from 1 to 2 carbon atoms; and $R^{iii}$=an amine moiety of the following general formula:

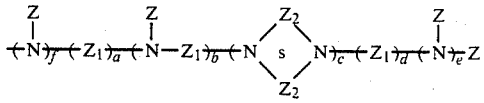

wherein

Z=the same or different constituent selected from:

(I) hydrogen, (II) hydrocarbyl groups of 1 to 10 carbon atoms, and (III) hydrocarbonyl groups of 2 to 10 carbon atoms;

$Z_1$=the same or different alkylene or hydroxy-substituted alkylene radical of 2 to 6 carbon atoms;

$Z_2$=carbonyl, alkylene carbonyl or alkylene of 2 to 4 carbon atoms with vicinal linkages; and a=0 or 1, preferably 1; b=0 to 4, preferably 0 to 2; c=0 or 1, preferably 0; d=0 or 1, preferably 0; e=0 or 1, preferably 1; and f=0 or 1, and=1 when c=0.

The proper concentration of the additive necessary in order to achieve the desired deposit control effect is dependent upon a variety of factors, including the type of fuel used, the presence of other detergents or dispersants, or other additives, etc. Generally, however, and in the preferred embodiment, the range of concentration of the additive in the base fuel is from 600 to 10,000 weight ppm, preferably from 1,000 to 6,000 weight ppm, and most preferably from 1,500 to 5,000 weight ppm of polyether polyamine.

The following examples are presented to illustrate a specific embodiment of the practice of this invention and should not be interpreted as a limitation upon the scope of that invention.

EXAMPLES

EXAMPLES 1

In a general test of the clean-up ability of the method of the present invention, a West German-made automobile equipped with a diesel engine having the following history of injector problems and repairs was obtained:

| Car Miles (Kilometers) | Repair Description |
|---|---|
| 12,905 (20,769) | Replaced four nozzles and cleaned fifth nozzle. |
| 15,291 (24,608) | Replaced five nozzles. |
| 18,203 (29,295) | Cleaned five nozzles and adjusted injector pump timing. |
| 20,865 (33,579) | Replaced five nozzles. |
| 34,382 (55,332) | Installed five new injectors. |

At 34,382 miles (55,332 kilometers), a polybutene amine gasoline fuel detergent additive, distinctly different from the additive used in the present invention, was added to the diesel fuel to provide a concentration of 133 parts per million by weight of the additive in the diesel fuel. This polybutene gasoline fuel additive was added to the diesel fuel speculating that the injectors might be cleansed and the engine operation improved because of that additive's known ability to clean deposits from the carburetors of gasoline-fueled engines. Instead, the problems noted before recurred, i.e., rough running, excessive noise and smoke, and the automobile was hard to start.

At 38,753 miles (62,367 kilometers), the injectors were disassembled, inspected and photographed. All injectors had partially blocked central holes and deposits in the transverse bore.

The fouled test injectors were reinstalled and dodecylphenylpoly(oxybutylene)-N-(2-aminoethyl) carbamate, an additive exemplary of that claimed for use in the present invention was added to a full fuel tank of automotive diesel fuel to a concentration of approximately 4,750 ppm active. A relatively immediate improvement in engine performance was noted, and after operation for 503 miles (809 kilometers) (i.e., through one tankful of additized fuel) the car was taken out of service and the injectors removed for inspection. It was observed that considerable deposits had been removed from the pintle central hole and the transverse bore.

EXAMPLE 2 Injector Clean-Up

Six new diesel engine injector nozzles were tested for air flow at 0.1 mm pintle lift using the method of the International Standards Organization (ISO) number 4010-77. The values obtained are given in Table I in the column headed "New".

These injector nozzles were then installed in the diesel engine of a six-cylinder American-made diesel engine passenger car. This car was driven on a laboratory distance accumulator test stand under a program control that simulated city/suburban driving conditions. The average speed was 30 miles per hour (48 kilometers per hour). Regular commercial diesel fuel was used.

After about 1,026 miles (1,651 kilometers) the injector nozzles were removed and tested as described above. The results are shown in Table I. The injector nozzles were then reinstalled in the same engine and the distance accumulation continued. After a total of 2,256 miles (3,361 kilometers), the same measurements were made and are reported in Table I. At this time it was concluded that the deposits had stabilized.

The fuel was replaced by the same base diesel fuel, but now containing approximately 6,000 weight ppm of a 50% solution of dodecylphenylpoly(oxybutylene)-N-(2-aminoethyl) carbamate in an inert, stable oleophilic organic solvent. The car was driven on the distance accumulator, under the same program control for an additional 375 miles (603 kilometers). The injector nozzles were removed and measured once again. The results are also given in Table I in the column headed "After Clean-up".

TABLE I

| | Injector Nozzle Test Air flow, cc/min. at 0.1 mm of Pintle lift | | | |
|---|---|---|---|---|
| Nozzle | New | After 1,026 mi (1,651 km) | After 2,256 mi (3,631 km) | After Clean-up [i.e., at 2,631 mi (4,234 km)] |
| 1 | 346 | 134 | 128 | 265 |
| 2 | 352 | 123 | 77 | 327 |
| 3 | 309 | 66 | 52 | 247 |
| 4 | 314 | 182 | 168 | 310 |
| 5 | 340 | 91 | 73 | 280 |
| 6 | 302 | 53 | 38 | 254 |
| Average | 327 | 108 | 89 | 280 |

Examination of the data in Table I shows that after 1,026 miles (1,651 kilometers) of normal driving, the average air flow through the injectors, at 0.1 mm of pintle lift, is reduced from about 330 cc/min. to about 110 cc/min. An additional 1,230 miles (1,979 kilometers) of driving lowers this value to about 90 cc/min. This decrease in air flow indicates a build-up of deposits in the injector nozzles limiting initial air flow to less than one-third the design amount. This reduction in the ISO test air flow relates directly to the reduction in diesel fuel quantity which will flow through such as nozzle, and in turn, this reduction in fuel flow causes hard starts, noise, emissions of unburned fuel, and other problems.

Surprisingly, the deposits in the fuel injectors are removed, and the flow rates returned to near normal by burning only about 13 gallons (49.2 liters) of fuel containing 3,000 weight ppm of an additive of the present invention. Additives that are effective at 0.1 mm of lift are also effective at other values of pintle lift (see Example 4).

EXAMPLE 3 Engine Clean-Up at Various Concentrations

Dirty injector nozzles were obtained from several different diesel engines of vehicles having combustion trouble as indicated by one or more of the following: noise, hard starts, exhaust smoke, low fuel economy, loss of power, rough idling, etc. These injector nozzles were installed in diesel vehicles which were then driven on a laboratory distance accumulator (see Example 2) until the air flow through the injector nozzles was about a constant value (ISO 4010-77) indicating stabilized deposits. The air flow rates at 0.1 mm pintle lift are given in Table II.

The diesel fuel was then additized with the indicated amount of dodecylphenylpoly(oxybutylene)-N(2-aminoethyl) carbamate, and the car was run under the same conditions as before until 20 gallons (75.7 liters) had been consumed (one tankful). The injector nozzles were again removed and the air flow rate measured. These values are given in Table II. After this measurement, the injector nozzles were manually cleaned by brushing to remove all deposits. Air flow rates were again measured, and are given in Table II.

TABLE II

| Additive Concentration Test | | | | | | |
|---|---|---|---|---|---|---|
| | | | Avg. Air Flow Rate, cc/min. | | | |
| Conc[1] (ppm) | No. of Injectors Tested[2] | No. of Vehicle Tests | With Stabilized Deposits | After Additive Clean-Up | After Manual Clean-Up | % Clean-Up |
| 500 | 2 | 1 | 115 | 88 | 206 | none |
| 1250 | 4 | 2 | 80 | 126 | 221 | 32 |
| 2000 | 3 | 2 | 113 | 163 | 235 | 46 |
| 2750 | 13 | 4 | 99 | 170 | 228 | 56 |
| 5000 | 5 | 1 | 83 | 152 | 229 | 50 |

[1]Concentration of polyoxyalkylene polyamine additive.
[2]In some cases, not all of the engine injectors were on test because of a shortage of dirty injectors.

Percent clean-up, due to burning one tankful of diesel fuel containing an additive of the present invention, was calculated by setting the air flow after manual clean-up as 100% and the air flow just before changing to the test fuel as 0%. The calculated clean-up values based on this date suggests that the additive concentration necessary for injector nozzle clean-up is in the range of 600 to 10,000 ppm, preferably 1,000 to 6,000 ppm, and more preferably 1,500 to 5,000 ppm.

EXAMPLE 4 Cetane Engine Injector Clean-Up

The standard engine for determining cetane values by ASTM D 613-79 was fitted with a new Bosch injector nozzle, type DNO SD 240/. This engine stand was eequipped with instruments for measuring: (1) combustion chamber pressure, (2) injector needle lift distance, and (3) crankshaft angle.

The engine was run at 900 RPM throughout the test. The compression ratio was adjusted to 21:1; the injection timing was set to 13° before top dead center and the amount of fuel injected was set at 13 ml/min. The cooling liquid was maintained at 212° F. (100° C.), the air intake at 150° F. (66° C.) and the oil temperature at 135° F. (57° C.). The fuel for this test was commercial #2 diesel (meeting ASTM D 975-78 specifications).

The air flow rate of the new nozzle was determined at several values of pintle lift by the method of ISO 4010-77. These values are given in Table III. The test engine was then run under the above described conditions for 20 hours. At the end of this time, the nozzle was removed and the air flow rate determined again. The results are given in Table III. The injector was reinstalled in the same engine which was then run for 20 additional hours with the same diesel fuel as before but now containing 10,000 ppm of a 50% solution of dodecylphenylpoly(oxybutylene)-N-(2-aminoethyl) carbamate in an inert, stable oleophilic organic solvent. At the end of the second 20-hour run, the nozzle was removed and tested for air flow rate as before. The results are given in Table III.

TABLE III

| Engine Stand 20-Hour Dirty-Up/Clean-Up Sequence | | | | | |
|---|---|---|---|---|---|
| | | Air Flow Rate | | | |
| | | After Dirty-Up | | After Clean-Up | |
| Pintle Lift (× 0.001") (0.0254 mm) | New Nozzle (cc/min.) | (cc/min.) | (% blocked) | (cc/min.) | (% of initial) |
| 1 | 80 | 33 | 59 | 76 | 96 |
| 2 | 91 | 39 | 57 | 89 | 98 |
| 4 | 100 | 46 | 54 | 96 | 96 |
| 6 | 110 | 52 | 53 | 103 | 94 |
| 8 | 120 | 64 | 47 | 112 | 93 |

TABLE III-continued

| Engine Stand 20-Hour Dirty-Up/Clean-Up Sequence | | | | | |
|---|---|---|---|---|---|
| | | Air Flow Rate | | | |
| | | After Dirty-Up | | After Clean-Up | |
| Pintle Lift (× 0.001") (0.0254 mm) | New Nozzle (cc/min.) | (cc/min.) | (% blocked) | (cc/min.) | (% of initial) |
| 10 | 130 | 76 | 42 | 125 | 96 |
| 12 | 145 | 88 | 39 | 140 | 97 |
| 14 | 170 | 102 | 40 | 165 | 97 |
| 16 | 210 | 130 | 38 | 195 | 93 |
| 18 | 290 | 165 | 43 | 260 | 90 |
| 20 | 365 | 205 | 44 | 300 | 82 |
| 22 | 430 | 260 | 40 | 360 | 84 |
| 24 | 515 | 330 | 36 | 400 | 78 |
| 26 | 610 | 420 | 31 | 490 | 80 |

The results in Table III show that running 20 hours on ordinary diesel fuel lays down sufficient deposits in a new injector nozzle to limit air flow to about 40 to 60% of its rate when new. After 20 hours of running on a diesel fuel containing an additive of the present invention, sufficient deposits in the injector nozzle are removed to restore the air flow to about 80 to 98% of the new nozzle rate.

What is claimed is:

1. A method for improving the operation of a compression ignition engine equipped with injectors for, and designed to be operated with hydrocarbon fuel boiling in the diesel range said method comprising:

operating said engine using an additized fuel prepared by introducing an effective amount of an additive into hydrocarbon fuel boiling in the diesel fuel range, said additive comprising a polyoxyalkylene amine of molecular weight from about 500 to about 2,500, the polyoxyalkylene moiety of said additive comprising 1 to 30 oxyalkylene units selected from oxyalkylene units having 2 to 4 carbon atoms, the amine moiety of said additive comprising from 1 to about 12 amine nitrogen atoms and from about 2 to about 40 carbon atoms, under conditions sufficient to clean performance-inhibiting deposits from said injectors or other fuel intake system or combustion chamber elements and wherein said additive comprises from about 600 to about 10,000 ppm by weight of a fuel additive of the formula:

$$R-O\left(\overset{R^{i}}{\overset{|}{C}}H-\overset{R^{ii}}{\overset{|}{C}}HO\right)_{n}X-R^{iii}$$

wherein

R = an alkyl group of 1 to 30 carbon atoms, aryl group of 6 to 30 carbon atoms, alkaryl group of 7 to 30 carbon atoms, aralkyl group of 7 to 30 carbon atoms, or methylol-substituted alkyl group of 5 to 30 carbon atoms;

$R^{i}$ and $R^{ii}$ independently = hydrogen, methyl or ethyl;

n = 1 to 30;

X = a connecting group selected from the group consisting of:

$$\text{ethylene } -\overset{Y}{\overset{|}{C}}H-\overset{Y'}{\overset{|}{C}}H-;$$

$$\text{methylol ethylene } -\overset{CH_2OH}{\overset{|}{C}}H-CH_2-;$$

-continued carbonyls $-\overset{O}{\overset{\|}{C}}-$; and methylene $-CHY-$;

where

Y and Y' independently = H, or an alkyl group of from 1 to 2 carbon atoms; and $R^{ii}$ = an amine moiety of the following general formula:

$$\left(N\right)_f\left(Z_1\right)_a\left(\overset{Z}{\overset{|}{N}}-Z_1\right)_b\left(N\right)_s^{Z_2}\left(N\right)_c\left(Z_1\right)_d\left(\overset{Z}{\overset{|}{N}}\right)_e Z$$

wherein

Z is the same or different constituent selected from:

(I) hydrogen, (II) hydrocarbyl groups of 1 to 10 carbon atoms, and (III) hydrocarbonyl groups of 2 to 10 carbon atoms, $Z_1$ = the same or different alkylene or hydroxy-substituted alkylene radical of 2 to 6 carbon atoms;

$Z_2$ = carbonyl, alkylene carbonyl or alkylene of 2 to 4 carbon atoms with vicinal linkages; and a = 0 or 1; b = 0 or 4;

c = 0 or 1; d = 0 or 1;

e = 0 or 1; and f = 0 or 1, and = 1 when c = 0;

and wherein the connecting group is bonded to an amino nitrogen atom in the amine moiety.

2. A method for improving engine operation according to claim 1 wherein the concentration of said additive is from about 1,500 ppm by weight to 5,000 ppm by weight.

3. A method for improving engine operation as claimed in claim 2 wherein said additive is introduced into said fuel in the form of a concentrate, said concentrate comprising an inert, stable oleophilic organic solvent boiling in the range of about 150° (66° C.) to 400° F. (204° C.) and from about 10 to about 50 weight percent of said additive.

4. A method of improving engine operation as claimed in claim 3 wherein said concentrate is introduced into said fuel while said fuel is in the fuel tank and system of a vehicle.

5. A fuel composition comprising a major portion of hydrocarbon boiling in the diesel fuel range and from about 600 to about 10,000 ppm by weight of a fuel additive of the formula:

$$R-O\left(\overset{R^i}{\overset{|}{C}H}-\overset{R^{ii}}{\overset{|}{C}H}O\right)_n X-R^{iii}$$

wherein

R = an alkyl group of 1 to 30 carbon atoms, aryl group of 6 to 30 carbon atoms, alkaryl group of 7 to 30 carbon atoms, aralkyl group of 7 to 30 carbon atoms, or methylol-substituted alkyl group of 5 to 30 carbon atoms;

$R^i$ and $R^{ii}$ independently = hydrogen, methyl or ethyl;

n = 1 to 30;

X = a connecting group selected from the group consisting of:

$-\overset{Y}{\overset{|}{C}H}-\overset{Y'}{\overset{|}{C}H}-$;

methylol ethylene $-\overset{CH_2OH}{\overset{|}{C}H}-CH_2-$;

carbonyls $-\overset{O}{\overset{\|}{C}}-$;

methylene $-CHY-$;

and where

Y and Y' independently = H, or an alkyl group of from 1 to 2 carbon atoms; and $R^{iii}$ = an amine moiety of the following general formula;

$$\left(N\right)_f\left(Z_1\right)_a\left(\overset{Z}{\overset{|}{N}}-Z_1\right)_b\left(N\right)_s^{Z_2}\left(N\right)_c\left(Z_1\right)_d\left(\overset{Z}{\overset{|}{N}}\right)_e Z$$

wherein

Z is the same or different constituent selected from:

(I) hydrogen, (II) hydrocarbyl groups of 1 to 10 carbon atoms, and (III) hydrocarbonyl groups of 2 to 10 carbon atoms, $Z_1$ = the same or different alkylene or hydroxy-substituted alkylene radical of 2 to 6 carbon atoms, $Z_2$ = carbonyl, alkylene carbonyl or alkylene of 2 to 4 carbon atoms with vicinal linkages; and a = 0 or 1; b = 0 or 4; c = 0 or 1; d = 0 or 1; e = 0 or 1; and f = 0 or 1, and = 1 when c = 0;

and wherein the connecting group is bonded to an amino nitrogen atom in the amine moiety.

6. A fuel composition according to claim 5 wherein the connection of said additive is from about 1,500 ppm by weight to 5,000 ppm by weight.

7. A method of claim 1 wherein n = 10 to 25, a = 1, b = 0 to 2, c = 0, d = 0, and e = 1.

8. The composition of claim 5 or 6 wherein n = 10 to 25, a = 1, b = 0 to 2, c = 0, d = 0, and e = 1.

* * * * *

UNITED STATES PATENT AND TRADEMARK OFFICE

CERTIFICATE OF CORRECTION

PATENT NO. : 4,778,481

DATED : October 18, 1988

INVENTOR(S) : Richard L. Courtney

It is certified that error appears in the above-identified patent and that said Letters Patent is hereby corrected as shown below:

Claim 5, Col. 12, Line 50, "b=0 or 4" should read --b=0 to 4--.

Claim 6, Col 12, Line 55, "connection of" should read --concentration of--.

Claim 1, Col. 11, Line 12, "$R^{ii}$" should read --$R^{iii}$--.

Claim 1, Col. 11, Line 34, "b=0 or 4" should read --b=0 to 4--.

Signed and Sealed this

Twenty-third Day of May, 1989

*Attest:*

DONALD J. QUIGG

*Attesting Officer*

*Commissioner of Patents and Trademarks*